US007301269B2

(12) United States Patent
Gofuku et al.

(10) Patent No.: US 7,301,269 B2
(45) Date of Patent: Nov. 27, 2007

(54) IMAGE DISPLAY APPARATUS PROVIDED WITH AN ION PUMP ASSEMBLY ARRANGED WITHIN AN EXTERNAL CONTAINER

(75) Inventors: Ihachiro Gofuku, Kanagawa-Ken (JP); Masaru Kamio, Kanagawa-Ken (JP); Hisanori Tsuda, Kanagawa-Ken (JP); Yasue Sato, Tokyo (JP); Yoshiyuki Shimada, Saitama-Ken (JP); Hiromasa Mitani, Kanagawa-Ken (JP); Kazuyuki Seino, Saitama-Ken (JP); Takashi Nishimura, Saitama-Ken (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 108 days.

(21) Appl. No.: 11/210,766

(22) Filed: Aug. 25, 2005

(65) Prior Publication Data

US 2006/0043865 A1 Mar. 2, 2006

(30) Foreign Application Priority Data

Aug. 27, 2004 (JP) ..... 2004-248547

(51) Int. Cl.
*H01J 17/24* (2006.01)
*H01J 19/70* (2006.01)
*H01J 61/26* (2006.01)

(52) U.S. Cl. ..... 313/495; 313/552; 313/553; 417/49; 417/51; 315/111.91

(58) Field of Classification Search ..... 313/495–497, 313/552, 553; 417/48–51; 315/111.91
See application file for complete search history.

(56) References Cited

U.S. PATENT DOCUMENTS

| | | | | |
|---|---|---|---|---|
| 4,334,829 | A * | 6/1982 | Harbaugh | 417/49 |
| 5,936,342 | A | 8/1999 | Ono et al. | 313/495 |
| 6,582,268 | B1 | 6/2003 | Jindai et al. | 445/6 |
| 6,590,338 | B1 * | 7/2003 | Fritz et al. | 313/553 |
| 6,726,520 | B2 | 4/2004 | Takeda et al. | 445/62 |
| 6,827,621 | B1 | 12/2004 | Enomoto et al. | 445/24 |
| 6,846,213 | B2 | 1/2005 | Sato | 445/6 |
| 6,848,961 | B2 | 2/2005 | Nomura et al. | 445/24 |
| 7,091,662 | B2 | 8/2006 | Hasegawa et al. | 313/555 |
| 2002/0180342 | A1 | 12/2002 | Yamada et al. | 313/493 |
| 2005/0009433 | A1 | 1/2005 | Nomura et al. | 445/24 |
| 2006/0043866 | A1 | 3/2006 | Tsuda et al. | 313/365 |
| 2006/0043870 | A1 | 3/2006 | Tsuda et al. | 313/495 |
| 2006/0043871 | A1 | 3/2006 | Kamio et al. | 313/495 |
| 2006/0049734 | A1 | 3/2006 | Sato et al. | 313/153 |
| 2006/0055637 | A1 | 3/2006 | Gofuku et al. | 345/75.2 |

FOREIGN PATENT DOCUMENTS

| | | |
|---|---|---|
| JP | 5-121012 | 5/1993 |
| JP | 9-82245 | 3/1997 |
| JP | 2000-133136 | 5/2000 |
| JP | 2000-311599 | 11/2000 |
| JP | 2000-315458 | 11/2000 |
| JP | 2001-210258 | 8/2001 |

* cited by examiner

*Primary Examiner*—Mariceli Santiago
(74) *Attorney, Agent, or Firm*—Fitzpatrick, Cella, Harper & Scinto

(57) ABSTRACT

Provided is an image display apparatus, including: a vacuum container which includes an electron source and an anode electrode opposed to the electron source; and an ion pump arranged so as to communicate through the vacuum container, in which: an ion pump container is composed of a non-electroconductive material; and an electroconductive film is formed on an external surface of the vacuum container on a side on which the ion pump container is mounted or on an internal surface of the ion pump container. The image display apparatus achieves: a reduction in weight of the ion pump; an improvement in compatibility to the vacuum container; and the prevention of an adverse effect of discharge inside the ion pump on image display.

8 Claims, 11 Drawing Sheets

IMAGE DISPLAY APPARATUS PROVIDED WITH AN ION PUMP ASSEMBLY ARRANGED WITHIN AN EXTERNAL CONTAINER

BACKGROUND OF THE INVENTION

1. Field of the Invention

The present invention relates to an image display apparatus using an electron-emitting device.

2. Related Background Art

In a flat display in which: a large number of electron-emitting devices are arranged as electron sources on a flat substrate; a phosphor as an image forming member on an opposing substrate is irradiated with electron beams emitted from the electron sources; and the phosphor is allowed to emit light to display an image, the inside of a vacuum container including the electron sources and the image forming member must be kept at a high vacuum. When a gas is generated in the vacuum container to increase the pressure in the container, the increase adversely affects the electron sources to reduce an electron emission amount, thereby making it impossible to display a clear image, although the degree of the adverse effect varies depending on the kind of the gas.

In particular, the following problems are characteristic of a flat display. A gas generated from an image display member accumulates near an electron source before it reaches a getter placed outside an image display area, so a local increase in pressure and the deterioration of the electron source incidental to the local increase occur. Japanese Patent Application Laid-Open No. H09-82245 describes that a getter is arranged in an image display area to immediately adsorb a generated gas, thereby suppressing the deterioration and breakage of a device. Japanese Patent Application Laid-Open No. 2000-133136 describes a structure in which a non-evaporable getter is arranged in an image display area and an evaporable getter is arranged outside the image display area. Furthermore, Japanese Patent Application Laid-Open No. 2000-315458 proposes that a series of operations consisting of degassing, getter formation, and seal bonding (making a vacuum container) are performed in a vacuum chamber.

Getters are classified into an evaporable getter and a non-volatile getter. The evaporable getter shows an extremely large exhaust velocity with respect to water or oxygen. However, each of the evaporable getter and the non-evaporable getter shows an exhaust velocity close to zero with respect to an inert gas such as argon (Ar). An argon gas is ionized by an electron beam to generate a plus ion. The plus ion is accelerated in an electric field for accelerating an electron to be bombarded with an electron source, thereby damaging the electron source. Furthermore, the argon ion may cause discharge inside an apparatus to break the apparatus.

Japanese Patent Application Laid-Open No. H05-121012 describes a method, as an exhausting means for exhausting an inert gas, involving connecting a sputter ion pump to a vacuum container of a flat display to maintain a high vacuum for a long period of time.

As shown in FIG. 9, in the flat panel display, a face plate 109 having a phosphor film and a container main body are hermetically sealed with a sealing material to constitute a vacuum container. An electrode structure is arranged in the container main body and has a field emission cathode, and an electron beam emitted from the cathode is modulated by an inner electrode, that is a modulation electrode to be directed toward the phosphor film for graphic display. An ion pump for maintaining a vacuum is joined to the container main body. In an embodiment of the ion pump, for example, 1,000 gauss (0.1 tesla, hereinafter, the unit "tesla" for a magnetic flux density is indicated by T) is applied by a magnet 121.

However, in the structure in which the ion pump is connected to the vacuum container via a metal seal such as an ICE flange, a heavy metal seal made of a metal material is locally placed on one side of the flat panel display. Moreover, the magnet is directly attached to an ion pump container 120 without any yoke, so the resultant weight is large. Accordingly, in joining the ion pump and the metal seal to the container main body, there arises inconvenience such as the deformation or breakage of a portion at which the metal seal is attached to the container main body. As a result, an event that the vacuum container leaks often occurs, with the result that a production yield reduces.

In addition, noise occurring when discharge occurs inside the ion pump may disturb an image of an image display apparatus.

SUMMARY OF THE INVENTION

The present invention has been made in the light of the conventional problems, and an object of the present invention is to provide a method of producing an image display apparatus through a simple step, the image display apparatus showing no occurrence of leak or the like, especially, the image display apparatus showing small changes in electron source properties with time, the image display apparatus having high display quality, the image display apparatus having high reliability, the image display apparatus being inexpensive. Another object of the present invention is to provide an image display apparatus which suppresses charging of a vacuum container member near an ion pump or of an ion pump container occurring as a result of driving of the ion pump, which prevents discharge from occurring to suppress, for example, the instability of image display and the breakage of an image display portion, and which has high reliability.

According to one aspect of the present invention, there is provided an image display apparatus, including: a vacuum container which includes an electron source and an anode electrode opposed to the electron source and in which a pressure is maintained at a reduced pressure; an anode power source for applying a voltage to the anode electrode; and an ion pump arranged so as to communicate through the vacuum container, in which: an ion pump container is composed of a non-electroconductive material; and an electroconductive film with its potential regulated is formed on an external surface of the vacuum container on a side on which the ion pump container is mounted.

According to another aspect of the present invention, there is provided an image display apparatus, including: a vacuum container which includes an electron source and an anode electrode opposed to the electron source and in which a pressure is maintained at a reduced pressure; an anode power source for applying a voltage to the anode electrode; and an ion pump arranged so as to communicate through the vacuum container, in which: an ion pump container is composed of a non-electroconductive material; and an electroconductive film with its potential regulated is formed on an internal surface of the ion pump container.

According to another aspect of the present invention, there is provided an image display apparatus, including: a vacuum container which includes an electron source and an anode electrode opposed to the electron source and in which a pressure is maintained at a reduced pressure; an anode power source for applying a voltage to the anode electrode; and an ion pump arranged so as to communicate through the vacuum container, in which: an ion pump container is composed of a non-electroconductive material; an electroconductive film with its potential regulated is formed on an external surface of the vacuum container on a side on which the ion pump container is mounted; and an electroconductive film with its potential regulated is formed on an internal surface of the ion pump container.

DESCRIPTION OF THE PREFERRED EMBODIMENTS

Figure 1:
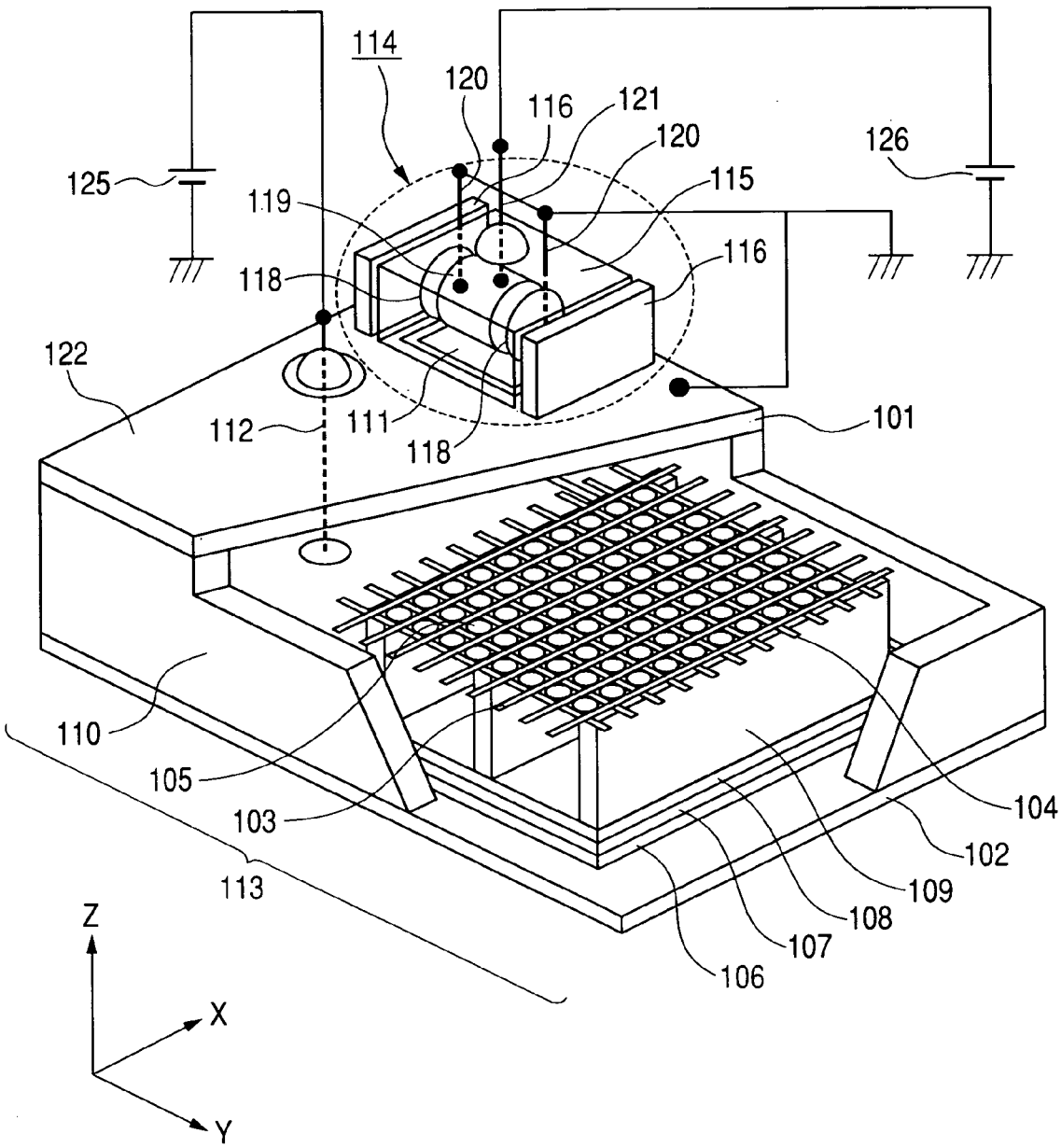
FIG. 1 is a perspective view schematically showing an example of an image display apparatus according to the present invention.

The present invention relates to an image display apparatus, including: a vacuum container which includes an electron source and an anode electrode opposed to the electron source and in which a pressure is maintained at a reduced pressure; an anode power source for applying a voltage to the anode electrode; and an ion pump arranged so as to communicate through the vacuum container, in which: an ion pump container is composed of a non-electroconductive material; and an electroconductive film with its potential regulated is formed on an external surface of the vacuum container on a side on which the ion pump container is mounted.

The present invention also relates to an image display apparatus, including: a vacuum container which includes an electron source and an anode electrode opposed to the electron source and in which a pressure is maintained at a reduced pressure; an anode power source for applying a voltage to the anode electrode; and an ion pump arranged so as to communicate through the vacuum container, in which: an ion pump container is composed of a non-electroconductive material; and an electroconductive film with its potential regulated is formed on an internal surface of the ion pump container.

The present invention also relates to an image display apparatus, including: a vacuum container which includes an electron source and an anode electrode opposed to the electron source and in which a pressure is maintained at a reduced pressure; an anode power source for applying a voltage to the anode electrode; and an ion pump arranged so as to communicate through the vacuum container, in which: an ion pump container is composed of a non-electroconductive material; an electroconductive film with its potential regulated is formed on an external surface of the vacuum container on a side on which the ion pump container is mounted; and an electroconductive film with its potential regulated is formed on an internal surface of the ion pump container.

In the present invention, each of the potential of the electroconductive film formed on the external surface of the vacuum container and the potential of the electroconductive film formed on the internal surface of the ion pump container is preferably the ground potential. In the case of an image display apparatus having both the electroconductive films, both the electroconductive films are preferably grounded.

In addition, in the case where an electroconductive film is formed on the external surface of the vacuum container, the electroconductive film is preferably removed at a portion where the ion pump is connected to the vacuum container.

In addition, a periphery of a connection portion between the ion pump container and the vacuum container is preferably reinforced with a reinforcing adhesive.

In the present invention, an electroconductive film with its potential regulated is formed at least one of on the external surface of the vacuum container and in the ion pump, so discharge based on charging is suppressed, the operation of the ion pump is stabilized, and no irregular gas emission occurs. As a result, an image display apparatus with its luminance stabilized can be provided.

Hereinafter, an image display apparatus will be described by taking as an example a structure having an electron source substrate on which an electron-emitting device is arranged (hereinafter, referred to as a rear plate) and an image forming substrate which is arranged in correspondence with the electron source substrate and which has a phosphor film and an anode electrode film as the anode electrode (hereinafter, referred to as a face plate).

<Description of Outline of Image Display Apparatus to Which the Present Invention is Applicable>

Figure 2:
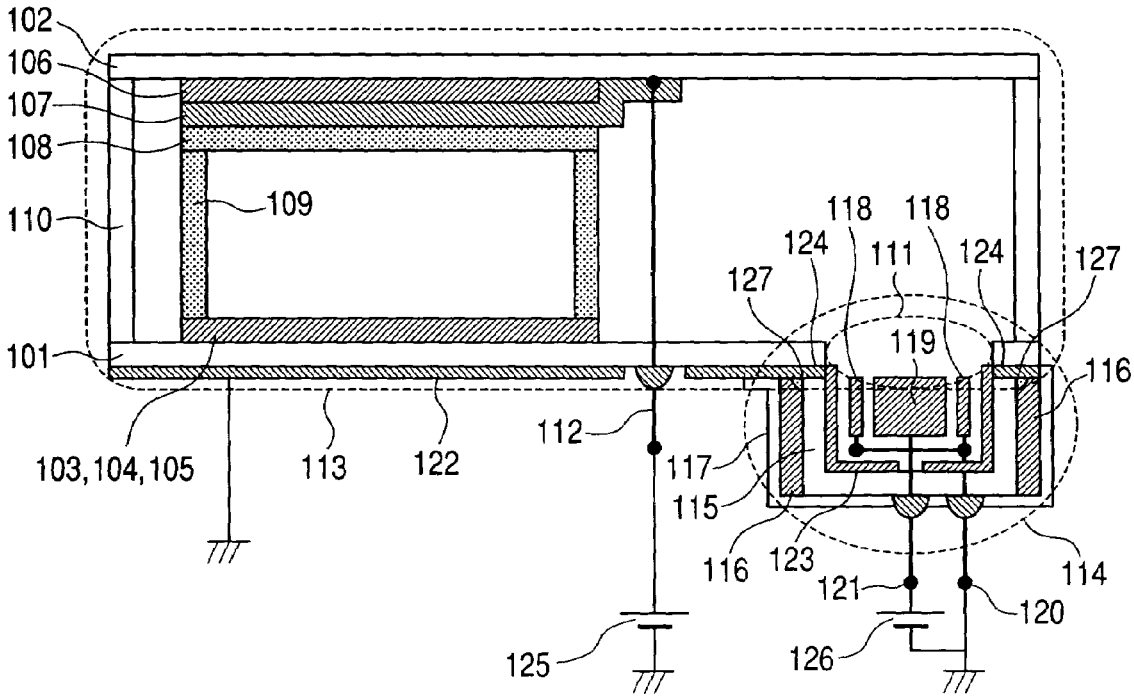
FIG. 2 is a sectional view schematically showing the example of the image display apparatus according to the present invention.

FIGS. 1 and 2 each schematically show an example of the structure of the image display apparatus according to the present invention. A phosphor 106 and a metal back 107 as the anode electrode film are formed on a face plate 102. A terminal portion 112 is drawn to the outside of a vacuum container in order to apply a high voltage to the metal back. Multiple electron-emitting devices are arranged on a rear plate 101, and an electron source 105 provided with appropriate wirings 103 and 104 is formed. Furthermore, a volatile getter 108 is formed on the metal back. The face plate, the rear plate, and a support frame (frame portion) 110 constitute the vacuum container. A support member (spacer) 109 is arranged between the rear plate and the face plate in order to support the atmospheric pressure. A high voltage is applied to the anode 107 from an anode power source 125 via the high voltage terminal 112.

Figure 3A:
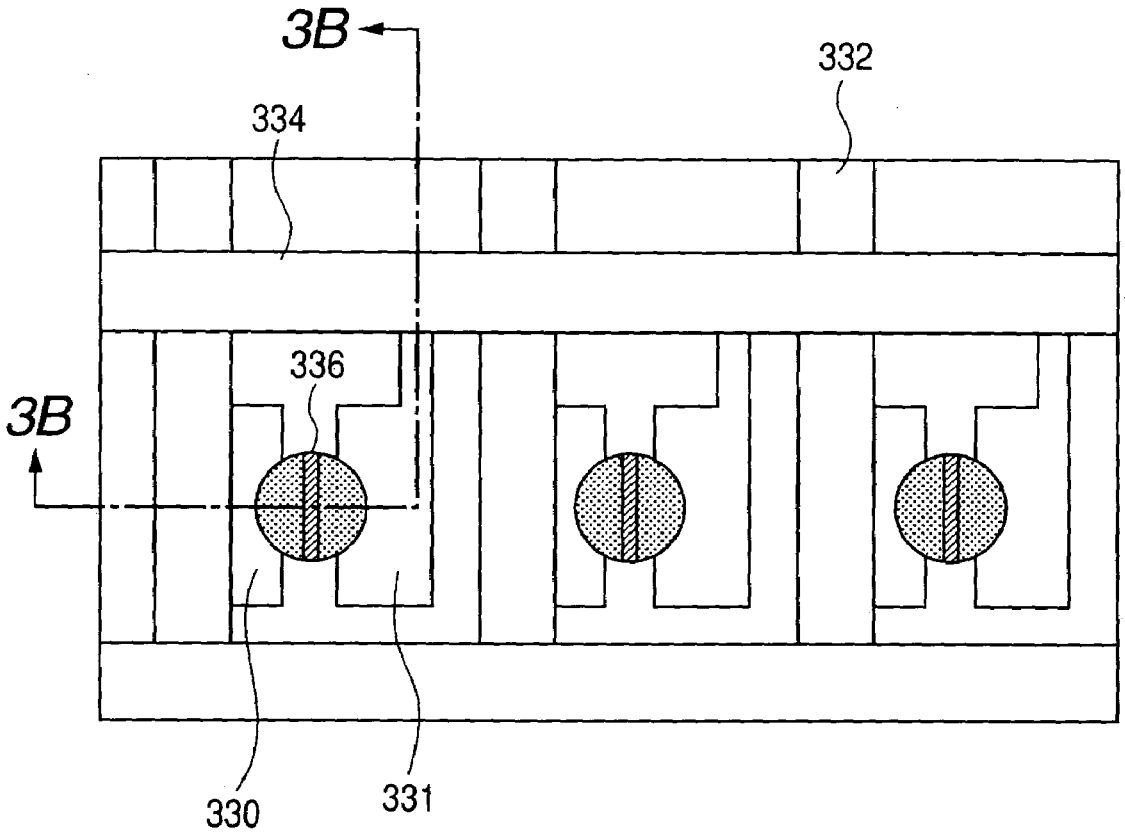
FIGS. 3A and 3B are schematic views each showing an example in which surface conduction electron-emitting devices are arranged in a simple matrix fashion.
Figure 3B:
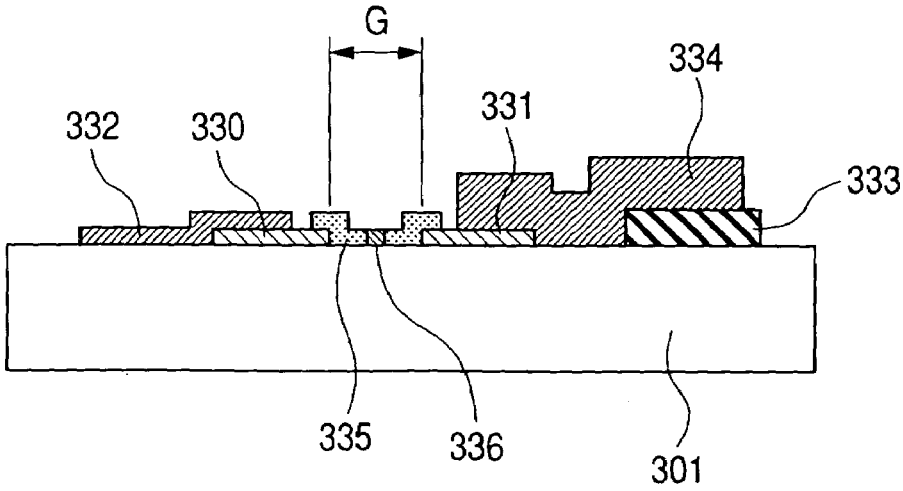

FIGS. 3A and 3B each schematically show the structure in which electron-emitting devices arranged two-dimensionally are connected with matrix wiring. A surface conduction electron-emitting device has been exemplified as the electron-emitting device, but an FED typified by a Spindt type or a flat field emission electron-emitting device also provides a similar effect. Hereinafter, description will be given by taking a surface conduction electron-emitting device as an example. FIG. 3A shows a plan view and FIG. 3B shows the structure of a section taken along the line 3B-3B.

A Y wiring (upper wiring) 334 and an X wiring (lower wiring) 332 are connected to an electron-emitting device 336 via device electrodes 330 and 331. The X wiring 332 is placed on an insulating substrate 301, and an insulating layer 333, the Y wiring 334, and the electron-emitting device 336 are sequentially formed. A general electroconductive material can be used for each of the opposing device electrodes 330 and 331.

A fine grain film composed of fine grain is preferably used for an electroconductive thin film 335 in order to obtain good electron emission property. The thickness of the thin film, which is appropriately set in consideration of step coverage to the device electrodes 330 and 331, the value of resistance between the device electrodes, a forming condition to be described later, and the like, is in general in the range of preferably several tenths nanometer to several hundred nanometers, or more preferably 1 nm to 50 nm. The value of resistance Rs of the thin film is in the range of 100 to 10 MΩ/μm. The value of Rs satisfies the relationship of $R=Rs(l/w)$ where R represents the resistance of a thin film having a thickness of t, a width of w, and a length of l. In the present specification, a forming treatment will be described by taking an energization treatment as an example. However, the forming treatment is not limited hereto, and includes a treatment for causing a film to generate a crack to form a high resistance state.

The electron-emitting portion 336 is constituted by a high-resistance crack formed in part of the electroconductive thin film 335, and depends on the thickness, quality, and material of the electroconductive thin film 335, an approach such a energization forming to be described later, and the like. Electroconductive fine grain each having a grain size in the range of several tenths nanometer to several ten nanometers may be present in the electron-emitting portion 336. The electroconductive fine grain contain part or all of elements of the materials constituting the electroconductive thin film 335. An electron emission effect can be improved by performing a treatment such as an energization activation treatment to allow the electron-emitting portion 336 and the electroconductive thin film 335 near it to have carbon or a carbon compound.

The face plate 102, the rear plate 101, the electron source 105, and any other structure thus formed are assembled, and the support frame 110 are sandwiched and joined between the face plate 102 and the rear plate 101. The rear plate 101 and the support frame 110 are fixed in advance to each other by means of frit glass, and the resultant is subjected to degassing and volatile getter formation in a vacuum chamber, and is then subjected to seal bonding (making a vacuum container) without any break of a vacuum. As shown in Japanese Patent Application Laid-Open No. 2000-315458, the face plate 102 and the rear plate 101 attached with the support frame are joined by means of In or an alloy thereof, or the like.

The image display apparatus of the present invention can be used for a display apparatus for television broadcasting, or a display apparatus for a teleconference system, a computer, or the like. The image display apparatus can also be used for, for example, an image forming apparatus as an optical printer constituted by using a photosensitive drum and the like.

<Description of Structure in Which Ion Pump is Installed>

Next, a structure in which an ion pump is installed will be described.

Figure 4:
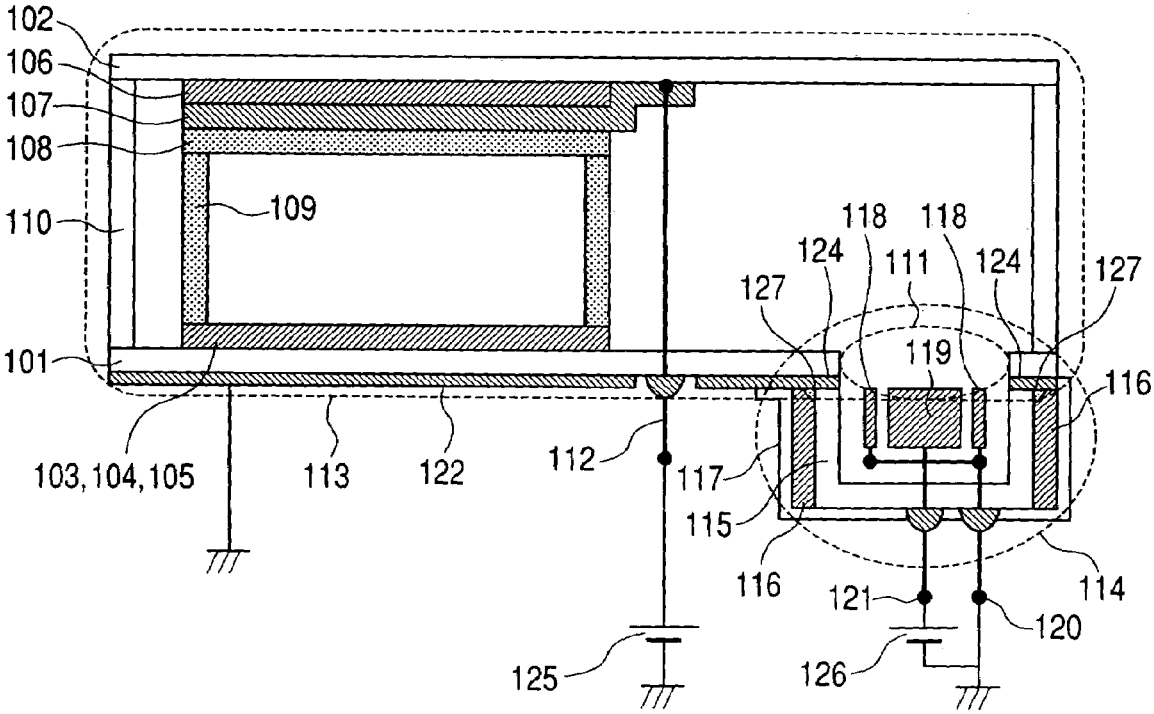
FIG. 4 is a schematic view showing an example of the image display apparatus according to the present invention.

FIG. 1 is a conceptual view of an image display apparatus having an ion pump 114 mounted on the external surface of a vacuum container 113, and FIGS. 2 and 4 are respectively sectional view of the image display apparatus, provided, however, that FIGS. 2 and 4 show different structures.

In the present invention, the container of the ion pump 114 is formed of a non-electroconductive material such as glass. Although the ion pump container is generally made of metal, the use of a non-electroconductive material, especially a ceramic such as glass allows the mechanical properties of the container to easily fit with those of the vacuum container of an image display apparatus main body. As a result, for example, fixing at the time of mounting can be easily performed, and the possibility that the container is peeled off owing to a stress generated in any subsequent step or at the time of handling, or a stress generated by an environment becomes low, thereby leading to a reduction in cost and an improvement in reliability.

In the figure, the ion pump 114 is mounted on the substrate (rear plate) 101 on which the electron-emitting devices 105 are arranged. A desorbed gas is exhausted form the panel through an opening 111 formed preliminary in the rear plate.

For example, the ion pump 114 is structured such that: a cylindrical ion pump anode 119 and ion pump cathodes 118 arranged on both sides of flat portions of the cylinder are placed in an ion pump container 115 made of glass; and magnet plates 116 are brought into close contact with the external sides of the ion pump container 115 so as to be parallel with the cathodes. The plate-like magnets 116 are fixed to a metallic yoke 117 by means of an adhesive, and the yoke 117 is fixed to the rear plate 101 by means of an adhesive. The ion pump anode 119 and the ion pump cathodes 118 are connected to embedded terminals 121 and 120 penetrating through the glass container 115, respectively. The anode terminal 121 is connected to a high voltage power source 126 for an ion pump, and the cathode terminal 120 is grounded.

A voltage 126 of 3 to 5 kV is applied to the ion pump anode 119 through the electrode 121 introduced from outside the container, and the ion pump cathodes 118 are grounded. The image display substrate (face plate) 102 has the metal back 107 formed on the phosphor 106, and an anode voltage (Va) 125 is applied to the face plate through the high voltage applying terminal 112.

When the image display apparatus is driven, electrons emitted from electron sources penetrate through the metal back 107, and members such as the phosphor 106 are irradiated with the electrons. Most of gases that chemically damage electron sources such as water, oxygen, carbon monoxide, and carbon dioxide out of the gases desorbed as a result of the irradiation are absorbed by the Ba getter film 108 formed on the metal back 107. In addition to those gases, inert gases are apt to damage electron sources by means of physical impacts, and argon is the most troublesome out of the inert gases. Argon has a small desorption rate but is rarely absorbed by a getter. Therefore, the pressure of argon in the vacuum container increases as the time elapses, so the possibility that argon is bombarded with an electron source to damage it increases.

In view of the above, the ion pump 114 is arranged. As a result, an increase in pressure of argon is suppressed to a low level even when the ion pump is placed at a position outside an image display area and distant from an electron source. Thus, a gas having strong chemical activity or an inert gas such as argon can be efficiently reduced, so the instability of device properties is suppressed.

However, the ion pump 114 is driven at high voltage of about 3 to 5 kV, and does not exert its exhausting action until ionized ions are allowed to impinge on the ion pump cathodes. Therefore, part of the ions leak from the cylindrical electrode to impinge on and charge an insulator portion near the ion pump 114. The insulator portion is charged to a maximum of 1 to 2 kV, and discharge will occur between an electrode of the ion pump 114 and a wiring of the image display apparatus or the like in the absence of a properly designed antistatic structure.

In view of the above, in one aspect of the present invention, an electroconductive film 122 is formed on the surface of the vacuum container on a side on which the ion pump is mounted as shown in FIGS. 1, 2, and 4. The formation enables the surface of the vacuum container as an insulating member near the ion pump 114 to be regulated to a predetermined potential and suppresses the occurrence of discharge.

The potential to be given to the electroconductive film formed on the external surface of the vacuum container can be appropriately selected from such a safe range that does not cause discharge. For example, the potential is in the range of the ground potential ±30 V (both inclusive) (which means that the absolute value is close to zero), preferably in the range of the ground potential ±10 V (both inclusive), or most preferably the ground potential. When the regulated potential is close to the ground potential, the risk of electric shock, the abnormal deformation of the vacuum container due to a Coulomb force generated as a result of charging, and the like can be suppressed.

A metal film, a transparent electroconductive film such as an ITO film, or the like can be used as the electroconductive film. When the ion pump is arranged on the rear plate side and the electroconductive film is formed on the external surface of the rear plate, a low-resistance electroconductive film such as a metal film can be used because no translucency is needed, and a more certain antistatic effect can be obtained. When the ion pump is arranged on the face plate side, a transparent electroconductive film is preferably used.

As shown in FIG. 1, a portion at which a terminal having a different potential such as the anode connection terminal 112 is drawn is provided with a region in which no electroconductive film is formed, the region having a size enough to avoid short circuit.

In a different aspect of the present invention, the potential inside the ion pump container is regulated. As shown in FIG. 2, an electroconductive film 123 is formed inside the ion pump container 115. A predetermined potential is given to the electroconductive film. The potential to be regulated, which can be appropriately selected to the extent that no discharge occurs, is preferably grounded. The potential of the electroconductive film 123 is preferably regulated by connecting the electroconductive film to a lead out of the ion pump cathode connection terminal 120. A portion at which the high voltage terminal 121 inside the ion pump container is placed is provided with a region in which no electroconductive film is formed. Thus, the charging of the ion pump container is suppressed, and hence discharge between the ion pump container and an ion pump electrode can be prevented. A metal film, a transparent electroconductive film such as an ITO film, or the like can be used as a material of the electroconductive film.

The electroconductive film formed on the external surface of the vacuum container and the electroconductive film formed inside the ion pump container may be in contact with each other when they have the same potential.

In allowing the ion pump container 115 to adhere to the external surface 101 of the vacuum container, the adhesiveness deteriorates when a film having different physical properties is present in an adhesion portion 124, and the film may be peeled off to be responsible for vacuum leak. In view of the above, in one aspect of the present invention, a reinforcing adhesive 127 is preferably applied to a periphery of a bonding portion between the ion pump container and the vacuum container (the rear plate 101 in each of FIGS. 1 and 2). An epoxy adhesive having a strong adhesive strength or the like is preferably used as the reinforcing adhesive. The reinforcing adhesive increases a fixing strength to reduce the possibility of vacuum leak.

Furthermore, in one aspect of the present invention, the electroconductive film 122 to be formed on the external surface of the vacuum container is preferably removed at the adhesion portion 124. As described above, in the absence of an electroconductive film at the adhesion portion, an adhesive strength increases, and, even when no reinforcing adhesive is applied, a failure of a panel due to vacuum leak can be prevented from occurring.

According to any one of those aspects, there can be provided a reliable image display apparatus which shows a small luminance distribution and a small change in luminance with time, and which has a reduced possibility of the occurrence of a failure due to vacuum leak.

Hereinafter, the present invention will be described in more detail by way of preferred embodiments. However, the present invention is not limited to these embodiments, and the substitution and change in design of each element may be made within the scope of the present invention.

Embodiment 1

In this embodiment, an image display apparatus having a structure shown in FIG. 4, that is, an image display apparatus having an electroconductive film formed on the external surface of a rear plate was produced. The image display apparatus was provided with an electron source 105 having multiple (768 rows×3,840 columns) surface conduction electron-emitting devices wired in a simple matrix fashion on a substrate. Hereinafter, a method of producing the image display apparatus of this embodiment will be described.

Step-x1 (Production of Glass Substrate Attached with Electroconductive Film)

A glass substrate 301 of PD-200 (manufactured by Asahi Glass Co., Ltd.) having a thickness of 2.8 mm was washed with a detergent, pure water, and an organic solvent, and an ITO film having a thickness of 0.3 μm was formed on one surface of the substrate by means of ordinary sputtering. Then, the ITO film was patterned by means of ordinary photolithography to remove a high voltage terminal portion and the like.

Step-a1 (Formation of Device Electrode)

The substrate produced in the step-x1 was washed with a detergent, pure water, and an organic solvent again, and an $SiO_2$ film having a thickness of 0.1 μm was formed on the other surface of the substrate by means of sputtering. Subsequently, a film of titanium (Ti) having a thickness of 5 nm was formed as a base layer on the $SiO_2$ film formed on the glass substrate 301 by means of sputtering, and a film of platinum (Pt) having a thickness of 40 nm was formed on the titanium film. After that, a photoresist (AZ1370, manufactured by Hoechst) was applied, and the whole was patterned through a series of photolithography consisting of exposure, development, and etching to form device electrodes 330 and 331. The device electrodes were formed with an interval of 10 μm between them, and each had an opposing length of 100 μm.

Step-b1 (Formation of Lower Wiring)

Materials for X and Y wirings are desired to have low resistances in such a manner that a substantially equal voltage is supplied to a large number of surface conduction electron-emitting devices, and materials, thicknesses, widths, and the like of the wirings are appropriately selected. An X wiring (lower wiring) 332 as a common wiring was formed into a line-like pattern so as to be in contact with the device electrode 330 and to connect the device electrodes with each other. Silver (Ag) photopaste ink was used as a material for the wiring. The wiring was formed by: performing screen printing by means of the ink; drying the resultant; subjecting the dried product to exposure and development to be a predetermined pattern; and baking the pattern at a temperature around 480° C. The wiring had a thickness of about 10 μm and a width of 50 μm. The width of an end portion of the wiring was increased in such a manner that the portion could be used as a wiring lead out electrode.

Step-c1 (Formation of Insulating Film)

An interlayer insulating layer was arranged to insulate the upper and lower wirings. The interlayer insulating layer was formed below the Y wiring (upper wiring) 334 to be described later so as to cover an intersection with the X wiring (lower wiring) 332 formed in advance and to electrically connect the upper wiring (Y wiring) 334 and the device electrode 331 with a contact hole opened in a connection portion. The step of forming the insulating layer was as follows. Photosensitive glass paste mainly composed of PbO was subjected to screen printing, and the resultant was subjected to exposure and development (this operation was repeated 4 times). Finally, the resultant was baked at a temperature around 480° C. The interlayer insulating layer was composed of 4 layers, and had a thickness of about 30 μm and a width of 150 μm.

Step-d1 (Formation of Upper Wiring)

The Y wiring (upper wiring) 334 was formed by: screen-printing AgO paste ink on the insulating film formed in advance; drying the applied ink; similarly applying the ink to the dried product; and baking the resultant at a temperature around 480° C. The Y wiring intersected the X wiring (lower wiring) 332 with the insulating film interposed between them, and was connected to the device electrode 331 at the contact hole portion of the insulating film. The Y wiring 334 is connected with the other device electrode 331, and functioned as a scanning electrode after the entirety had been turned into a panel. The Y wiring 334 had a thickness of about 15 μm. Although not shown, a lead out terminal to an external drive circuit was formed in the same manner as that described above. Thus, a substrate having X and Y matrix wirings was formed.

Step-e1 (Formation of Device Film)

After the substrate had been sufficiently cleaned, the surface of the substrate was treated with a solution containing a repellent so as to be hydrophobic. A dilution of DDS (manufactured by Shin-Etsu Chemical Co., Ltd.) in ethyl alcohol was used as the repellent, and the repellent was sprayed onto the substrate by means of a spray method and dried with warm air at 120° C. After that, a device film 335 was formed between the device electrodes by means of an ink jet application method. In this embodiment, in order to form a palladium film as the device film, 0.15 wt % of a palladium-proline complex was dissolved into an aqueous solution composed of water and isopropyl alcohol (IPA) (water:IPA=85:15) to prepare an organic palladium-containing solution. A slight amount of other additive was also added. An ink jet spout system using a piezo device was used as liquid droplet imparting means. After that, the substrate was heated and baked at 350° C. for 10 minutes in the air to be palladium oxide (PdO). The resultant PdO film had a dot diameter of about 60 μm and a maximum thickness of 10 nm.

Step-f1 (Reductive Forming (Hood Forming))

Figure 5A:
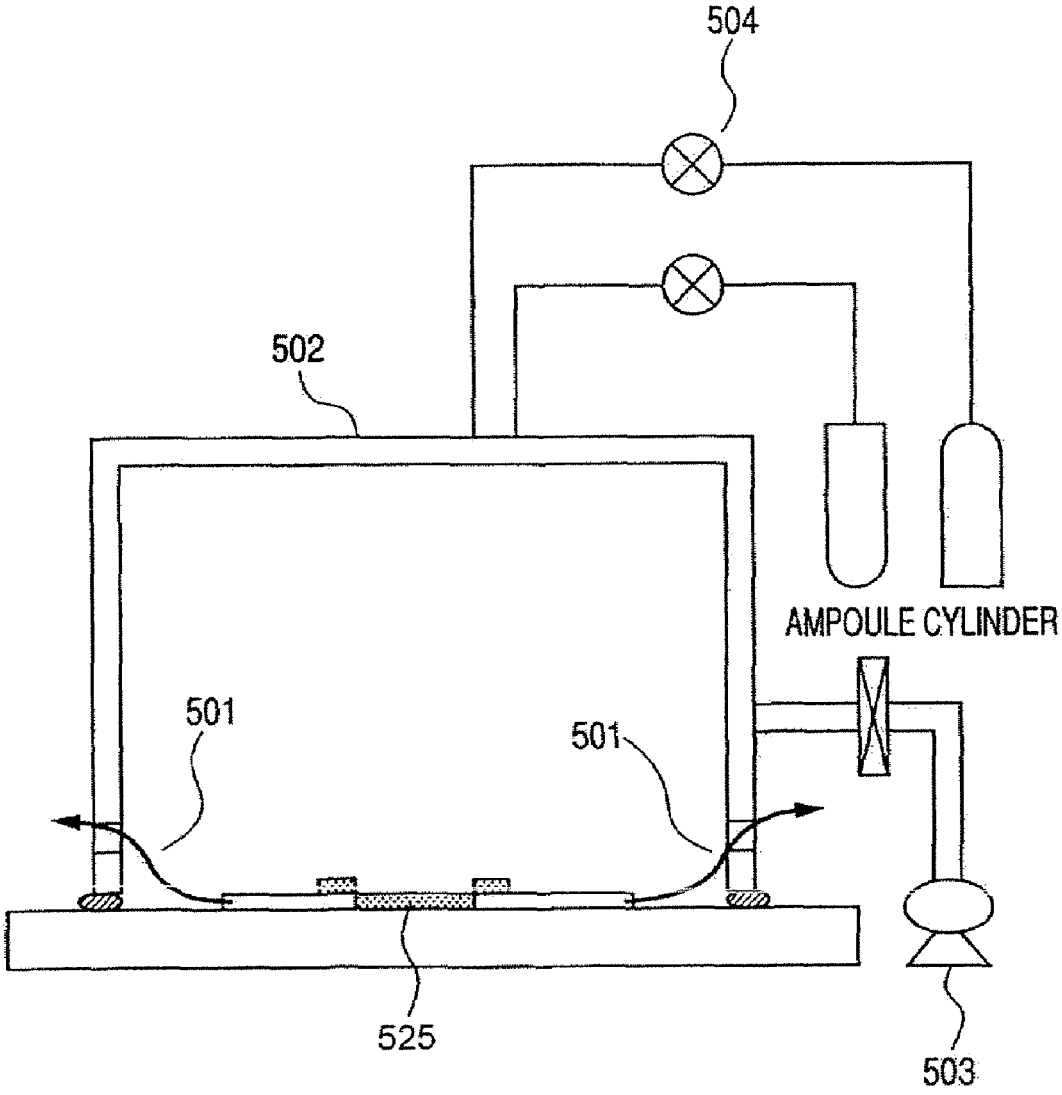
FIGS. 5A and 5B are views for explaining a forming/activation process.
Figure 5B:
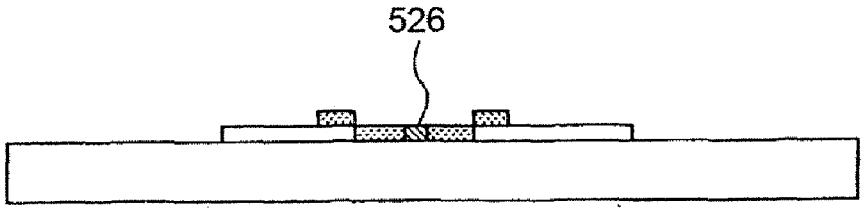

In a step called forming, the electroconductive thin film in the surface conduction electron-emitting device was energized to cause a crack to develop inside the film, to thereby form an electron-emitting portion. The outlines of the apparatus and method used for this purpose were as shown in FIG. 5. First, the entire substrate was covered with a hood-like cap 502 with a lead out electrode portion around the substrate left, and a vacuum space was established between the cap and the substrate by means of exhausting means 503. Subsequently, a voltage from an electrode terminal portion 501 connected to an external power source was applied between the X and Y wirings to cause a current to flow between the device electrodes. Thus, an electroconductive thin film 525 was locally broken, deformed, or denatured to form an electron-emitting portion 526 having a high electrical resistance. Forming conditions such as a voltage to be applied are detailed in Japanese Patent Application Laid-Open No. 2000-311599. Appropriate conditions were selected from the conditions.

In the forming step, reduction was promoted by energization and heating under a vacuum atmosphere containing a slight amount of hydrogen gas, so palladium oxide, (PdO) was changed to a palladium (Pd) film. At that time, a crack was partly generated in the film owing to the reduction and contraction of the film. The resultant electroconductive thin film 335 had a value of resistance Rs in the range of 100 to 10 MΩ. Device resistance measurement was performed to judge the point of time at which the forming treatment was completed, and the point of time at which a resistance showed a value 1,000 or more times as high as that before the forming treatment was judged to be the completion of the forming.

Step-g1 (Activation-Carbon Deposition)

Since an electron emission efficiency in a state after the forming was extremely low, the surface conduction electron-emitting device was subjected to a treatment called activation in order to increase the electron emission efficiency. The treatment involved: covering the substrate with a hood-like cap to establish a vacuum space between the cap and the substrate in the same manner as in the forming in the presence of an organic compound and under an appropriate pressure; repeatedly applying a pulse voltage from outside to the device electrodes through the X and Y wirings; introducing a gas containing a carbon atom; and depositing carbon or a carbon compound derived from the gas as a carbon film 336 near the crack.

Tolunitrile was used as a carbon source in the step, and was introduced into the vacuum space through a slow leak valve 504, and the pressure in the vacuum space was maintained at $1.3\times10^{-4}$ Pa. The pressure of tolunitrile to be introduced, which is slightly affected by the shape of a vacuum device, a member used for the vacuum device, and the like, is suitably about $1\times10^{-5}$ Pa to $1\times10^{-2}$ Pa. In this step as well, conditions such as a voltage to be applied were selected from the conditions described in Japanese Patent Application Laid-Open No. 2000-311599.

Since a device current If was nearly saturated in about 60 minutes, the energization was stopped, the slow leak valve was closed, and the activation treatment was terminated. An electron source substrate was produced through the above steps.

Step-y1 (Assembly and Attachment of Ion Pump)

First, a glass container 115 for an ion pump perforated with holes for anode and cathode terminals was prepared. The holes may be formed by melting, or may be formed mechanically by means of a microprocessing grinding apparatus. Meanwhile, an area outside the image display area of the rear plate 101 that had been subjected to the above steps was perforated with an opening 111 for an ion pump through polishing. It should be noted that a substrate perforated with a hole in advance may be prepared and subjected to the steps up to the step-g1.

Then, the ion pump cathodes 118 and the ion pump anode 119 were fixed to metal support members, and the support members-were connected to the respective cathode and anode terminals by means of spot welding or the like. The electrode terminals 120 and 121 were passed through the holes opened in the glass container 115 in advance and temporarily fixed with frit glass. Similarly, the glass container 115 for an ion pump was temporarily fixed with frit glass so as to surround the opening 111 arranged in the rear plate 101. The rear plate 101 attached with the ion pump 114 was baked at 420° C. for 1 hour to form the ion pump anode terminal 121 and the cathode terminal 120 and to mount the ion pump 114. Furthermore, an epoxy adhesive 127 was applied to a periphery of an ion pump container adhesion portion, and was solidified to fix the ion pump container.

Step-h1 (Attachment of Support Frame)

Figure 6:
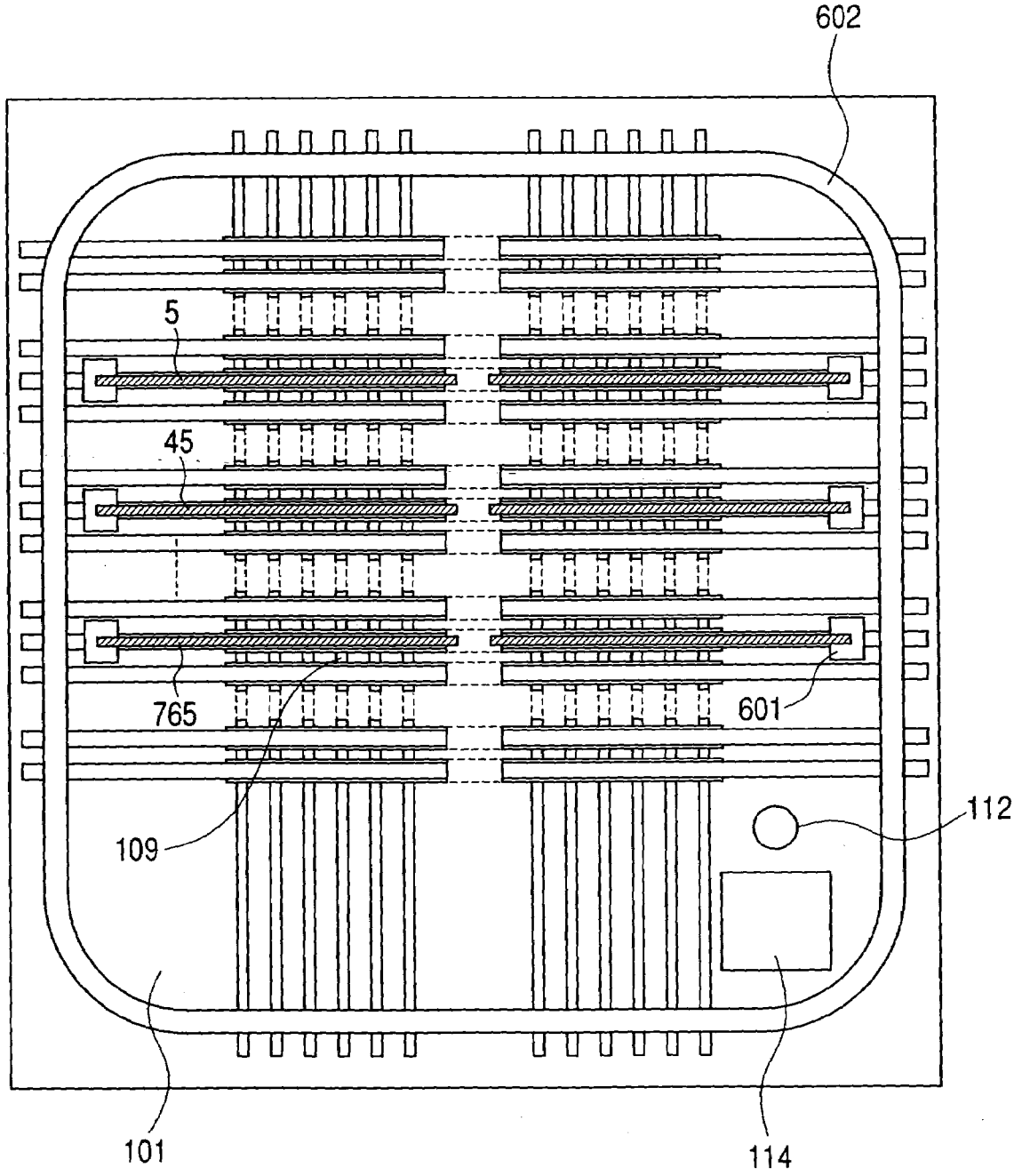
FIG. 6 is a schematic view showing the arrangement of a spacer in an example of the image display apparatus according to the present invention.

Next, as shown in FIG. 6, frit glass was applied to a predetermined position on the rear plate 101, and the support frame 110 was aligned with and temporarily fixed to the rear plate 101. After that, the resultant was baked at 390° C. for 30 minutes to attach the support frame to the rear plate 101.

Step-i1 (Vertical Arrangement of Spacer)

As shown in FIG. 6, the spacers 109 were placed on part of the lines (No. 5, 45, 85, 125, 165, 205, 245, 285, 325, 365, 405, 445, 485, 525, 565, 605, 645, 685, 725, and 765) of the Y wiring (upper wiring) of the electron source substrate 101. The spacers were fixed outside an area having a device (pixel area) by means of a ceramic adhesive (Aron Ceramic W, manufactured by Toa Gosei Co., Ltd.) with an insulating board (thin plate glass) 601 as a support.

Step-j1 (Formation of Face Plate)

First, a glass substrate (PD-200 having a thickness of 2.8 mm) was sufficiently washed with a detergent, pure water, and an organic solvent. Next, a silver paste was applied to a pattern such as an anode connection terminal portion or an In-filled base portion, and the whole was baked at a temperature around 480° C. Subsequently, the phosphor film 106 was applied by means of a printing method, and the surface was subjected to a smoothing treatment (generally called "filming") to form a phosphor portion. The phosphor film 106 had stripe shaped phosphors (R, G, and B) and a black electroconductive material (black stripe) arranged alternately. Furthermore, the metal back 107 composed of an Al thin film and having a thickness of 50 nm was formed on the phosphor film 106 by means of sputtering. Those films 106 and 107 were not in contact with the anode connection terminal 112 or the opening 111 for an ion pump, but a silver paste pattern (not shown) connected the metal back 107 and the anode connection terminal 112.

Step-k1 (In Application)

As described in Japanese Patent Application Laid-Open No. 2001-210258, a portion above the silver paste-printed portion arranged in advance in the circumferential portion of the face plate 102 was filled with In. A portion above the silver paste-printed portion arranged in advance on the support frame 110 was also filled with In.

Step-l1 (Vacuum Degassing, Getter Flashing, and Seal Bonding)

Figure 7:
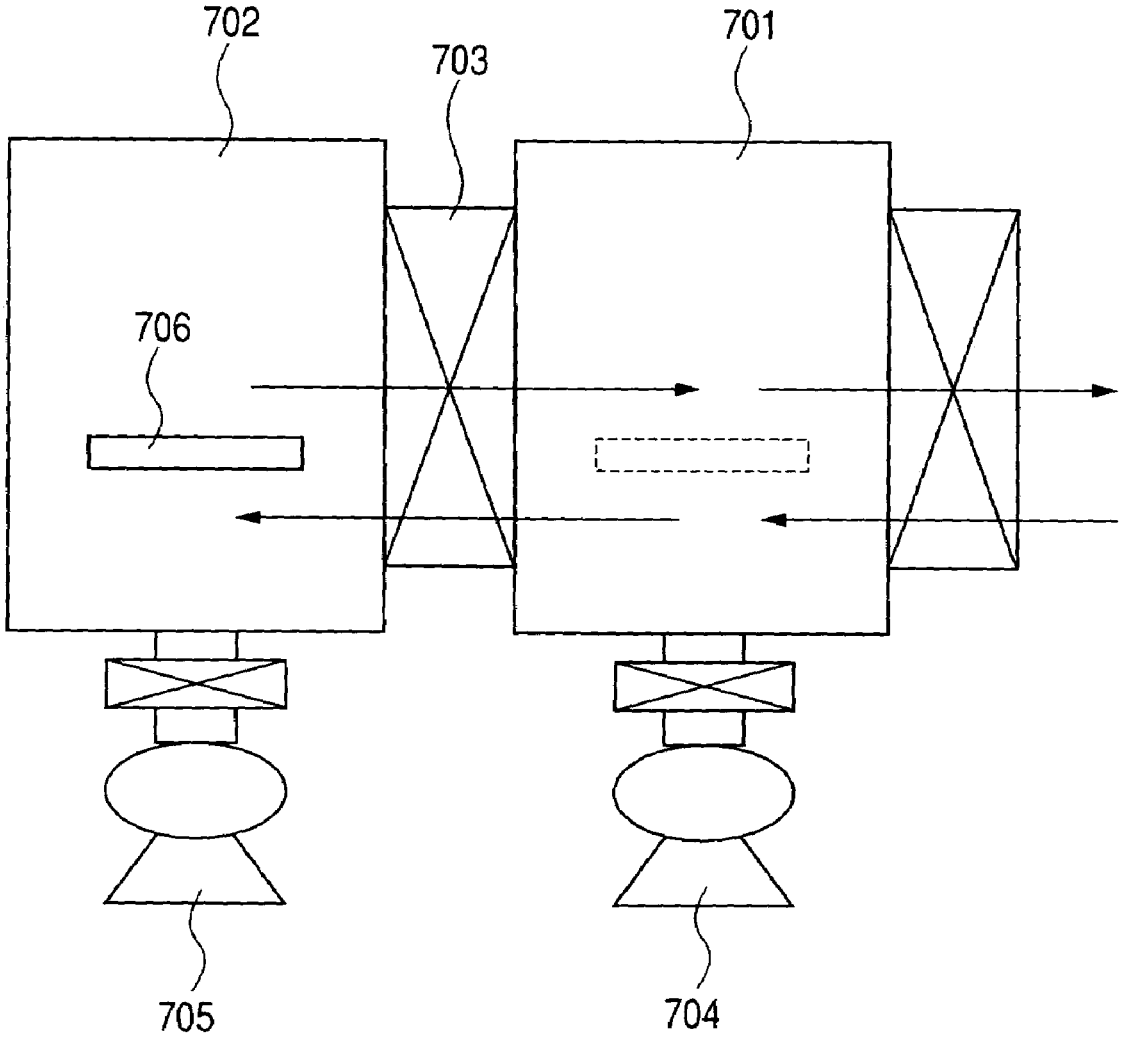
FIG. 7 is a schematic view showing a vacuum pumping apparatus for performing baking, getter flashing, and seal bonding in forming an image display apparatus.

Next, the rear plate 101 and the face plate 102 formed through the above steps were set in a vacuum chamber shown in FIG. 7, and a vacuum container was produced through a step similar to that described in each of Japanese Patent Application Laid-Open No. 2000-315458 and Japanese Patent Application Laid-Open No. 2001-210258. As shown in FIG. 7, the vacuum chamber was roughly divided into a load chamber 701 and a vacuum treatment chamber for performing a process such as baking, getter flashing, or seal bonding, and the chambers were connected with each other through a gate valve 703 or the like. A separate treatment chamber may be prepared for each process. However, in this embodiment, the series of processes were performed in one treatment chamber 702. The load chamber and the treatment chamber were provided with vacuum pumps 704 and 705, respectively. A jig 706 on which the rear plate 101 and the face plate 102 had been mounted was loaded into the load chamber, conveyed to the treatment chamber, passed through the load chamber after the treatment, and conveyed to the outside of the vacuum chamber as indicated by arrows.

Figure 8A:
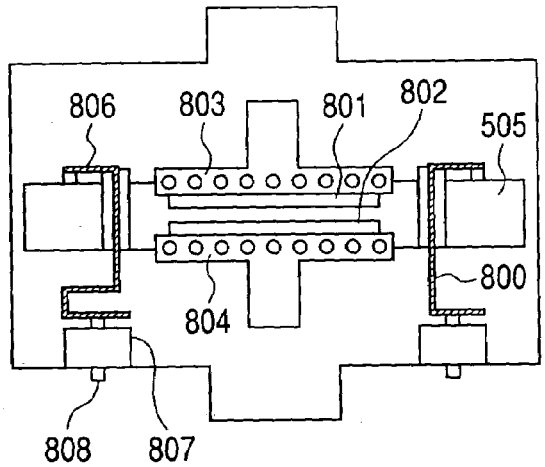
FIGS. 8A, 8B, 8C, and 8D are views for explaining processes of baking, getter flashing, and seal bonding in the formation of the image display apparatus according to the present invention.
Figure 8B:
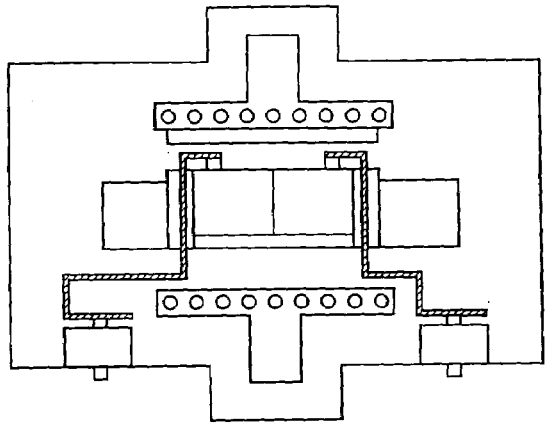
Figure 8C:
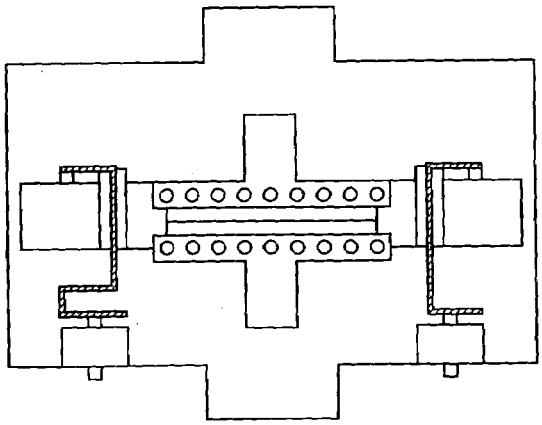
Figure 8D:
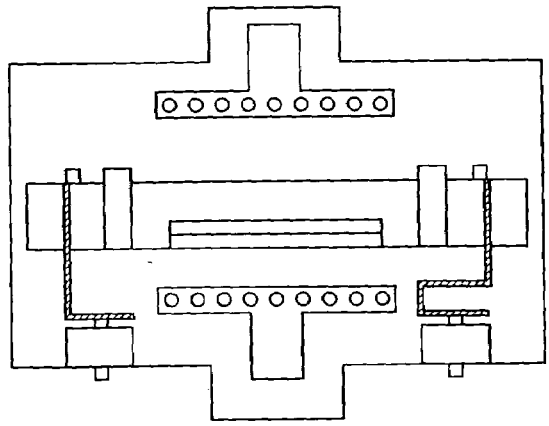

FIGS. 8A to 8D schematically show the respective processes in the vacuum treatment chamber. FIG. 8A shows the state of baking, FIG. 8B shows the state of getter flashing, FIG. 8C shows the state of seal bonding, and FIG. 8D shows the state where a jig is ready for being conveyed to the outside. The baking was such that the rear plate 101 and the face plate 102 conveyed by a conveying jig 800 were heated by hot plates 803 and 804. A current lead-in wire 807 provided for a cover-like jig 805 for getter flashing incidental to the conveying jig 800 was connected to an electrode 808 to be evacuated to the outside to flash a getter through energization and heating. At the time of seal bonding, as in the case of the baking, the cover-like jig 805 moved to a side. A load was applied while the substrate was heated by the hot plates to attach the rear plate and the face plate to each other using In. After the completion of the seal bonding, the hot plates escaped vertically and the resultant vacuum container together with the conveying jig were conveyed to the outside. In addition to the above procedure, a step such as electron beam irradiation cleaning for irradiating the face plate 102 with an electron beam while scanning the electron beam to perform cleaning for the purpose of enhancing a degassing effect of the face plate may be performed.

Hereinafter, the contents of the respective steps will be briefly described. The baking was performed as follows. The hot plates 804 and 803 were moved to be placed above and below the face plate 102 and the rear plate 101 mounted on the conveying jig 800, and this state was kept at about 300° C. for 1 hour. A temperature increase for about 3 hours and a temperature decrease for about 12 hours were performed before and after the keeping of the state, respectively (a).

Next, the rear plate 101 and part of the conveying jig supporting it were raised by about 50 cm together with the upper hot plate. Subsequently, the covet-like jig 805 was moved to a space between both the rear and face plates to be in contact with the face plate 102. The jig was of a box shape, and 18 ring shaped barium getters were arranged on an inner ceiling. Each of the barium getter rings was connected to a current lead-in terminal to be flashed through heating by a current (b). The arrangement of the barium getter rings is determined in advance on condition that they are each uniformly formed into a film having a thickness of about 50 nm on the face plate 102. In actuality, a current of 12 A was allowed to pass through each barium getter ring for a period of 12 seconds to sequentially perform flashing.

After that, the jig for getter flashing was returned to its original position and removed from the space between the rear and face plates. Subsequently, the rear plate 101, the supporting jig, and the upper hot plate 803 were lowered to their original positions (c), and the hot plate was heated to 180° C. over about 1 hour. After the hot plate had been kept at 180° C. for about 3 hours, the rear plate supporting jig was lowered little by little to apply a load of about 60 kgf/cm$^2$ between both the rear and face plates. The hot plate was naturally cooled in this state to room temperature, to thereby complete seal bonding.

Step-m1 (Mounting and Systematization)

A flexible cable was mounted on the vacuum container formed through the above steps, and the ion pump 114 was connected at the same time. The anode terminal portion 121 of the ion pump 114 was subjected to potting, a treatment for solidification by means of a moisture-proof and high-resistance resin, as in the case of the anode connection terminal portion 112 of the image display portion, and a high voltage cable was connected. The high voltage cable of the image display portion was connected to the anode power source 125, and the high voltage cable of the ion pump 114 was connected to the high voltage power source 126 for an ion pump. After the completion of such mounting, the vacuum container was stored in a metal casing which had an opening on the face plate side in such a manner that the image display portion could be seen and which was connected to the ground. Then, an electroconductive tape was pasted on the electroconductive film 122 formed on the external surface of the rear plate 101 for connecting the film to a lead, and the lead was connected to the metal casing. Furthermore, an acrylic board was attached to the opening of the metal casing with a distance of about 5 mm between the board and the face plate 102. The resultant was connected to a dedicated driver apparatus as required to be subjected to a step of stabilizing device properties such as pre-driving or aging. At that time, a voltage was applied from the anode power source to the ion pump 114 to drive the ion pump 114. After that, a driver IC, the casing, and the like were assembled to complete the form of an image display apparatus.

A microammeter was connected between the ion pump cathode terminal 120 of the resultant image display apparatus after the step-m1 and the ground. First, a voltage of 3.5 kV was applied from the high voltage power source 126 for an ion pump to start current measurement. Immediately after the application of the ion pump voltage, a current of about 10 μA started to flow, and was lowered to 0.1 μA or less in about 1 minute. Subsequently, a voltage of 10 kV was applied from the anode power source 125 to measure a change in ion pump current while the image display apparatus was driven. As a result, nearly no current exceeding 0.1 μA flowed for a period of about 10 hours from the start of the driving. The result shows that the ion pump efficiently exhausted the vacuum container to a vacuum and nearly no local discharge due to charging near the container occurred. The result also shows that the ion pump container was securely fixed to the vacuum container and no vacuum leak occurred. Accordingly, high reliability and a reduction in cost were achieved.

Embodiment 2

Figure 9:
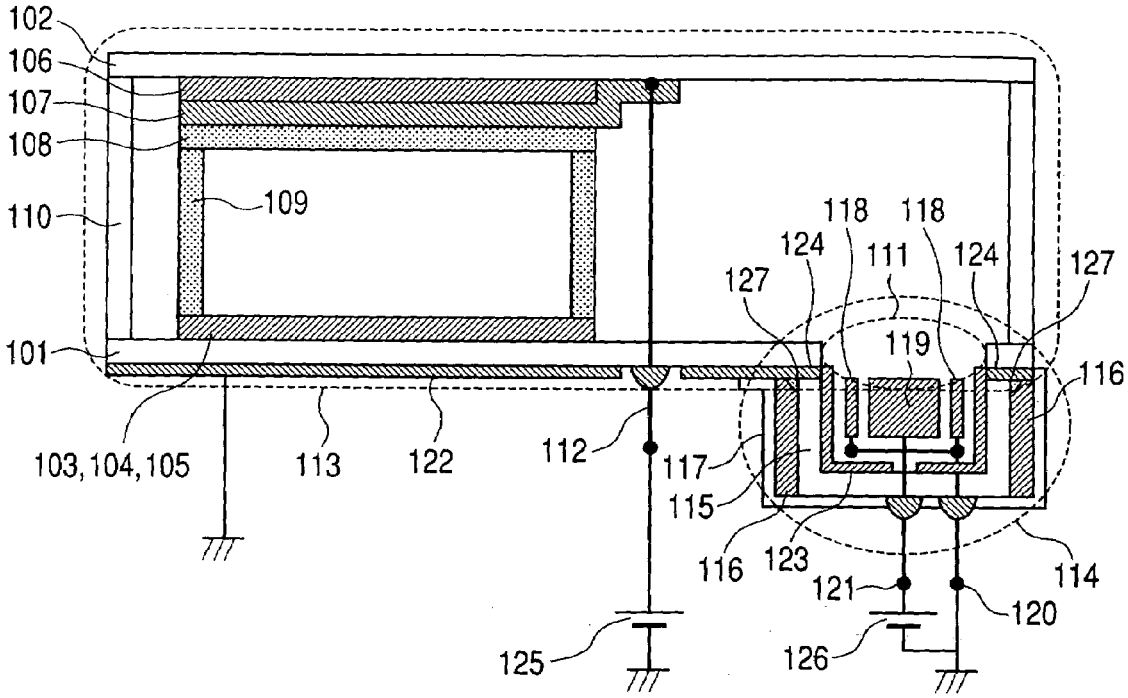
FIG. 9 is a schematic view showing an example of the image display apparatus according to the present invention.

In this embodiment, an image display apparatus having a structure shown in FIG. 9, that is, an image display apparatus having an electroconductive film formed on the external surface of a rear plate and an electroconductive film formed on the internal surface of an ion pump container was produced.

Steps-x2 and a2 To g2

Steps similar to the steps-x1 and a1 to g1 described in Embodiment 1 were repeated.

Step-y2 (Assembly and Attachment of Ion Pump)

First, a glass container 115 for an ion pump perforated with holes for ion pump anode and cathode terminals was prepared. The holes may be formed by melting, or may be formed mechanically by means of a microprocessing grinding attachment. After the glass container had been washed with an organic solvent, a photoresist was applied to a predetermined position inside the glass container by means of a plate, and the whole was baked at 90° C. for 10 minutes to form a pattern for lift-off. In this state, a solution prepared by dispersing fine particles of antimony-doped tin oxide into ethanol was applied by means of spraying to form three layers. The resultant was pre-baked at 120° C. for 30 minutes, subjected to ultrasonic washing in acetone for 10 minutes, and baked at 380° C. for 20 minutes to form an electroconductive film having a desired shape (ATO film). Meanwhile, an area outside the image display area of the rear plate 101 that had been subjected to the above steps was perforated with an opening 111 for an ion pump through polishing. It should be noted that a substrate perforated with a hole in advance may be prepared and subjected to the steps up to the step-g1.

Then, the ion pump cathodes 118 and the ion pump anode 119 were fixed to metal support members, and the support members were connected to the respective cathode and anode terminals by means of spot welding or the like. The electrode terminals 120 and 121 were passed through the holes opened in the glass container 115 for an ion pump in advance and temporarily fixed with frit glass. Similarly, the glass container 115 for an ion pump was temporarily fixed with frit glass so as to surround the opening 111 arranged in the rear plate 101. The rear plate 101 attached with the ion pump 114 was baked at 420° C. for 1 hour to form the ion pump anode terminal 121 and the cathode terminal 120 and to mount the ion pump 114. Furthermore, an epoxy adhesive 127 was applied to a periphery of an ion pump container adhesion portion, and was solidified to fix the ion pump container.

Steps-h2 to m2

Steps similar to the steps-h1 to m1 described in Embodiment 1 were repeated.

An ion pump current was measured for the image display apparatus obtained through the above steps in the same manner as in Embodiment 1. Immediately after the application of an ion pump voltage, a current of about 10 μA started to flow, and was lowered to 0.1 μA or less in about 1 minute. A change in current was continuously recorded for about 10 hours in this state. However, no current equal to or larger than 0.1 μA was observed. The result shows that the ion pump efficiently exhausted the vacuum container to a vacuum and no local discharge due to charging near the ion pump container occurred. The result also shows that the ion pump container was securely fixed to the vacuum container and no vacuum leak occurred. Accordingly, high reliability and a reduction in cost were achieved.

Embodiment 3

Figure 10:
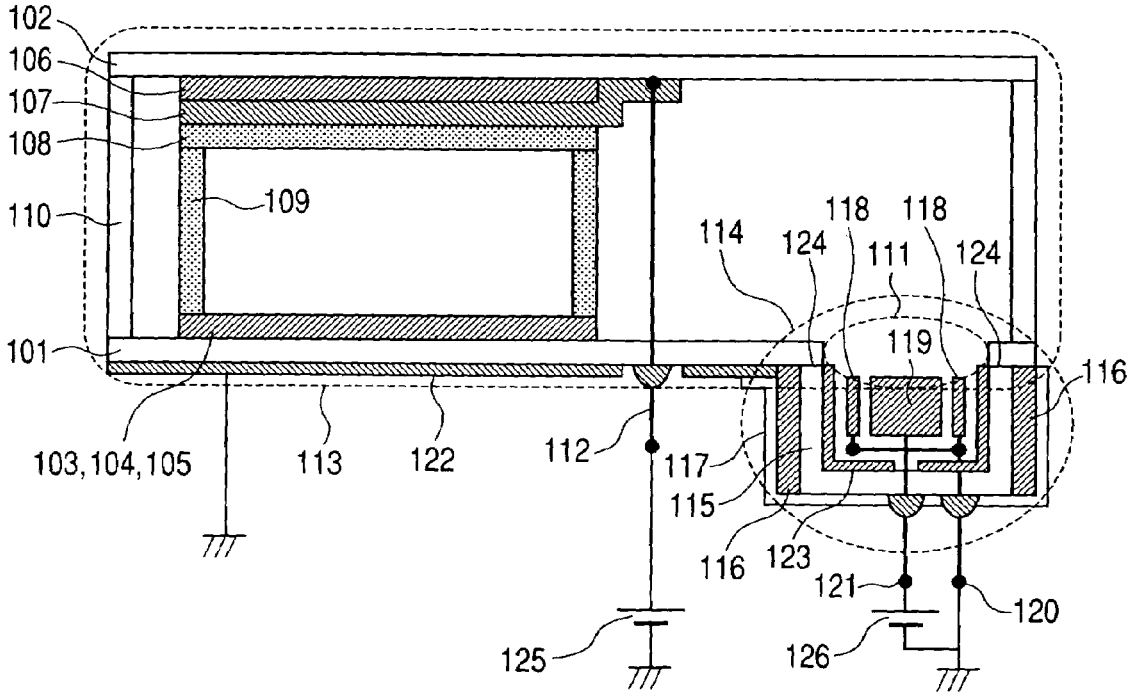
FIG. 10 is a schematic view showing an example of the image display apparatus according to the present invention.

In this embodiment, an image display apparatus having a structure shown in FIG. 10, that is, an image display apparatus having an electroconductive film formed on the external surface of a rear plate and an electroconductive film formed on the internal surface of an ion pump container, the electroconductive film on the external surface of the rear plate being removed at a portion to be connected to an ion pump, was produced.

Step-x3 (Production of Glass Substrate Attached with Electroconductive Film)

A glass substrate 301 of PD-200 (manufactured by Asahi Glass Co., Ltd.) having a thickness of 2.8 mm was washed with a detergent, pure water, and an organic solvent, and an ITO film having a thickness of 0.3 μm was formed on one surface of the substrate by means of ordinary sputtering. Then, the ITO film was patterned by means of ordinary photolithography to remove a high voltage terminal portion and a portion to be bonded to the ion pump container in a subsequent step.

Steps-a3 to g3

Steps similar to the steps-a1 to g1 described in Embodiment 1 were repeated.

Step-y3 (Assembly and Attachment of Ion Pump)

An ion pump container was prepared in the same manner as in Embodiment 2, and the rear plate 101 having an electroconductive film having a desired shape (ATO film) formed on the internal surface of the ion pump container was similarly perforated with a hole. Then, the ion pump cathodes 118 and the ion pump anode 119 were fixed to metal support members, and the support members were connected to the respective cathode and anode terminals by means of spot welding or the like. The electrode terminals 120 and 121 were passed through the holes opened in the glass container 115 for an ion pump in advance and temporarily fixed with frit glass. Similarly, the glass container 115 for an ion pump was temporarily fixed with frit glass so as to surround the opening 111 arranged in the rear plate 101. At this time, the end portion of the glass container was aligned with the position from which the electroconductive film had been removed in the step-x3. The rear plate 101 attached with the ion pump 114 was baked at 420° C. for 1 hour to form the ion pump anode terminal 121 and the cathode terminal 120 and to mount the ion pump 114. Furthermore, an epoxy adhesive 127 was applied to a periphery of an ion pump container adhesion portion, and was solidified to fix the ion pump container.

An ion pump current was measured for the image display apparatus obtained through the above steps in the same manner as in Embodiment 1. Immediately after the application of an ion pump voltage, a current of about 10 μA started to flow, and was lowered to 0.1 μA or less in about 1 minute. A change in current was continuously recorded for about 10 hours in this state. However, nearly no current equal to or larger than 0.1 μA was observed. The result shows that the ion pump efficiently exhausted the vacuum container to a vacuum and nearly no local discharge due to charging near the ion pump container occurred. The result also shows that the ion pump container was more securely fixed to the vacuum container because no ITO was present at the interface between the frit and the rear plate 101, and no vacuum leak occurred. Accordingly, high reliability and a reduction in cost were achieved.

Embodiment 4

Figure 11:
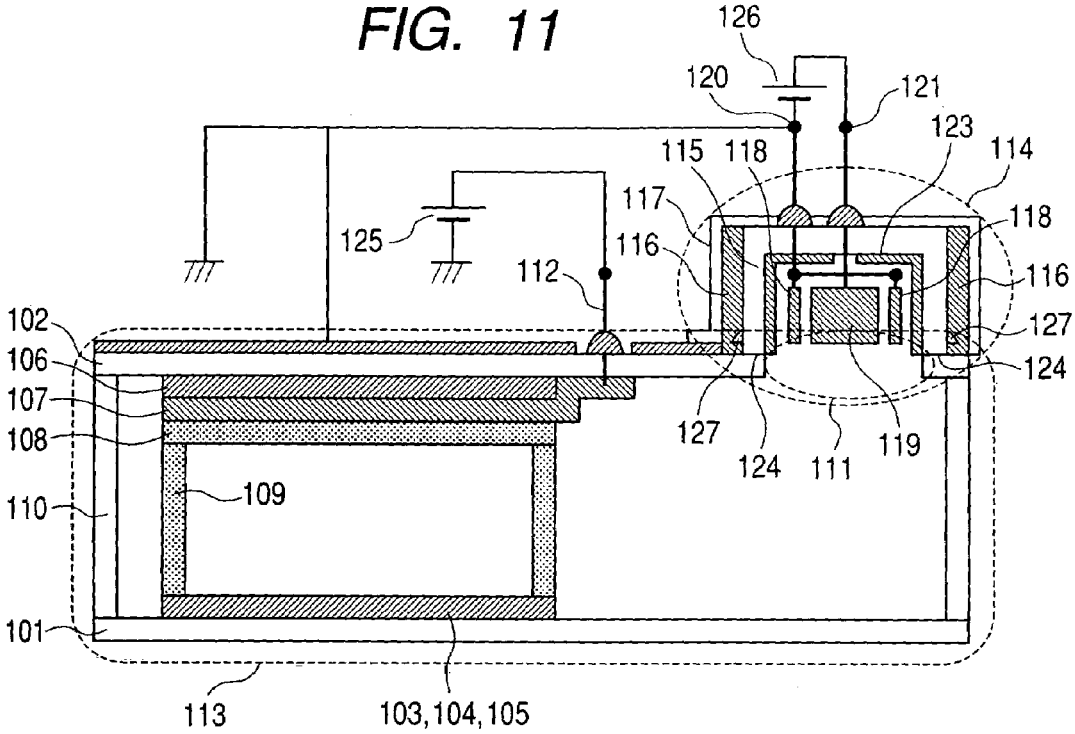
FIG. 11 is a schematic view showing an example of the image display apparatus according to the present invention.

In this embodiment, description will be given by taking as an example an image display apparatus having a structure shown in FIG. 11, that is, an image display apparatus in which an ion pump is mounted on the side of the face plate 102. The effect of mounting the ion pump on the side of the face plate 102 is omitted because it is the same as the effect of mounting the ion pump on the side of the rear plate 101.

Step-x4 (Production of Substrate Attached with Electroconductive Film)

A glass substrate 302 (PD-200 having a thickness of 2.8 mm) was perforated with a hole for an anode connection terminal, a hole for an ion pump anode terminal, and the opening 111 for an ion pump. The holes may be formed in advance in a mold, or may be formed in a flat plate thereafter. The portions to be perforated with holes were placed outside an image display area. The glass substrate 302 was washed with a detergent, pure water, and an organic solvent, and an ITO film having a thickness of 0.3 μm was formed on one surface of the substrate by means of ordinary sputtering. Then, the ITO film was patterned by means of ordinary photolithography to remove a high voltage terminal portion and the like.

Steps-a4 To g4, h4, And i4

Steps similar to the steps-a1 to g1, h1, and i1 described in Embodiment 1 were repeated.

Step-j4 (Formation of Face Plate)

A substrate for a face plate was washed with a detergent, pure water, and an organic solvent again. Next, a silver paste was applied to a pattern such as a lead-out wire from an anode connection terminal portion or an In-filled base portion, and the whole was baked at a temperature around 480° C. Subsequently, the phosphor film 106 was applied by means of a printing method, and the surface was subjected to a smoothing treatment (generally called "filming") to form a phosphor portion. The phosphor film 106 had stripe shaped phosphors (R, G, and B) and a black electroconductive material (black stripe) arranged alternately. Furthermore, the metal back 107 composed of an Al thin film and having a thickness of 50 nm was formed on the phosphor film 106 by means of hot stamping.

Step-y4 (Assembly and Attachment of Ion Pump)

First, a glass container 115 for an ion pump perforated with holes for anode and cathode terminals was prepared. The holes may be formed by melting, or may be formed mechanically by means of a microprocessing grinding attachment. Meanwhile, an area outside the image display area of the face plate 102 that had been subjected to the above steps was perforated with an opening 111 for an ion pump through polishing. It should be noted that a substrate perforated with a hole in advance may be prepared and subjected to the steps up to the step-g1.

Then, the ion pump cathodes 118 and the ion pump anode 119 were fixed to metal support members, and the support members were connected to the respective cathode and anode terminals by means of spot welding or the like. The electrode terminals 120 and 121 were passed through the holes opened in the glass container 115 for an ion pump in advance and temporarily fixed with frit glass. Similarly, the glass container 115 for an ion pump was temporarily fixed with frit glass so as to surround the opening 111 arranged in the face plate 102. The face plate 102 attached with the ion pump 114 was baked at 420° C. for 1 hour to form the ion pump anode terminal 121 and the cathode terminal 120 and to mount the ion pump 114. Furthermore, an epoxy adhesive 127 was applied to a periphery of an ion pump container adhesion portion, and was solidified to fix the ion pump container.

Steps-k4 To l4

Steps similar to the steps-k1 to l1 described in Embodiment 1 were repeated.

Step-m4 (Mounting and Systematization)

A flexible cable was mounted on the vacuum container formed through the above steps, and the ion pump 114 was connected at the same time. The anode terminal portion 121 of the ion pump 114 was subjected to potting, a treatment for solidification by means of a moisture-proof and high-resistance resin, as in the case of the anode connection terminal portion 112 of the image display portion, and a high voltage cable was connected. The high voltage cable of the image display portion was connected to the anode power source 125, and the high voltage cable of the ion pump 114 was connected to the high voltage power source 126 for an ion pump. After the completion of such mounting, the vacuum container was stored in a metal casing which had an opening on the face plate side in such a manner that the image display portion could be seen. Then, an electroconductive tape was pasted on the electroconductive film 122 formed on the external surface of the face plate 102 for connecting the film to a lead, and the lead was connected to the metal casing. Furthermore, an acrylic board was attached to the opening of the metal casing with a distance of about 5 mm between the board and the face plate 102. The resultant was connected to a dedicated driver apparatus as required to be subjected to a step of stabilizing device properties such as pre-driving or aging. At that time, a voltage was applied from the anode power source to the ion pump 114 to drive the ion pump 114. After that, a driver IC, the casing, and the like were assembled to complete the form of an image display apparatus.

An ion pump current was measured for the image display apparatus obtained through the above steps in the same manner as in Embodiment 1. Immediately after the application of an ion pump voltage, a current of about 10 μA started to flow, and was lowered to 0.1 μA or less in about 1 minute. A change in current was continuously recorded for about 10 hours in this state. However, nearly no current equal to or larger than 0.1 μA was observed. The result shows that the ion pump efficiently exhausted the vacuum container to a vacuum and no local discharge due to charging near the ion pump container occurred. The result also shows that the ion pump container was securely fixed to the vacuum container and no vacuum leak occurred. Accordingly, high reliability and a reduction in cost were achieved.

Embodiment 5

Figure 12:
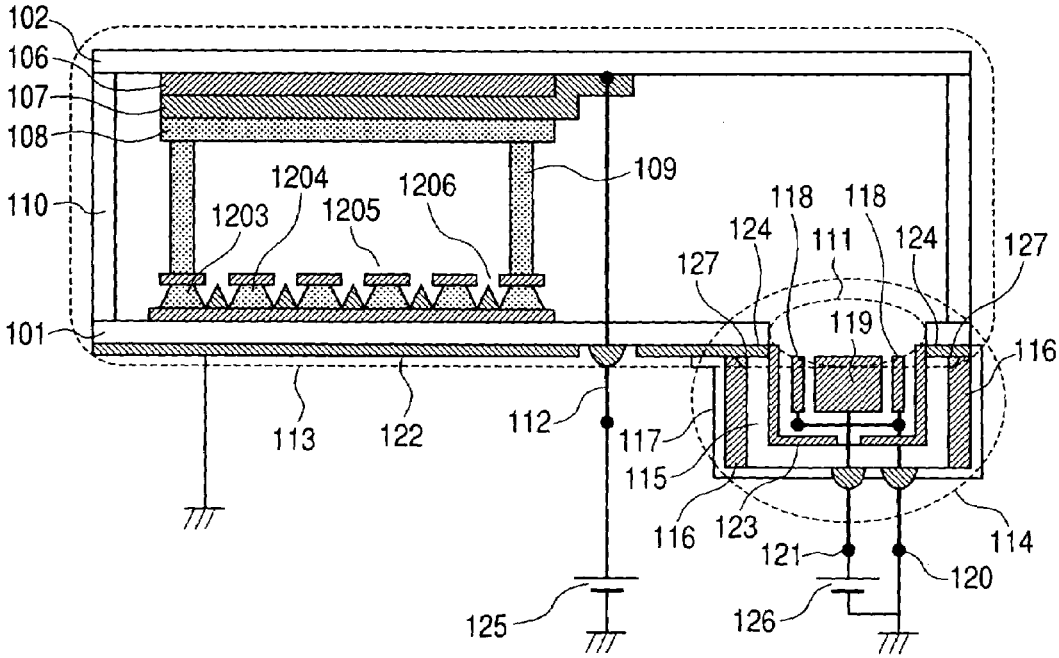
FIG. 12 is a schematic view showing an example of the image display apparatus according to the present invention.

Next, an example in which a different electron-emitting device is used will be described with reference to FIG. 12.

Step-x5

The step was performed in the same manner as in the step-x1 of Embodiment 1.

Step-a5 (Formation of Cathode)

Next, the glass substrate formed in the step-x5 was washed again. An Mo film having a thickness of 0.25 μm was formed on the other surface of the substrate (the surface except the surface on which the ITO film had been formed) by means of sputtering, and a cathode electrode (1203) serving also as an X wiring was formed by means of ordinary photolithography.

Step-b5 (Formation of Insulating Layer and Gate)

An $SiO_2$ film (1204) having a thickness of 1 μm was formed on the substrate by means of sputtering, and subsequently an Mo film having a thickness of 0.25 μm was formed. After that, the Mo and $SiO_2$ films were perforated with holes each having a diameter of 1.5 μm by means of ordinary photolithography to form a gate electrode (1205) serving also as a Y wiring and an emitter forming hole.

Step-c5 (Formation of Emitter)

Subsequently, an $SiO_2$ film having a thickness of 1.5 μm was formed on the hole by means of sputtering, and a portion having a thickness of 1.2 μm of the film was etched back. Then, a W film having a thickness of 1 μm was formed, and the remaining $SiO_2$ film having a thickness of 0.3 μm was lifted off to form a cone shaped emitter electrode (1206).

Step-y5 (Assembly and Attachment of Ion Pump)

The step was performed in the same manner as in the step-y1 of Embodiment 1.

Step-d5 (Attachment of Support Frame)

The step was performed in the same manner as in the step-h1 of Embodiment 1.

Step-e5 (Vertical Arrangement of Spacer)

The step was performed in the same manner as in the step-i1 of Embodiment 1. Thus, the rear plate 101 on which Spindt type electron-emitting devices were arranged was formed.

Step-f5 (Formation of Face Plate)

The step was performed in the same manner as in the step-j1 of Embodiment 1.

Step-g5 (In Application)

The step was performed in the same manner as in the step-k1 of Embodiment 1.

Step-h5 (Vacuum Degassing, Getter Flashing, and Seal Bonding)

The step was performed in the same manner as in the step-l1 of Embodiment 1.

Step-i5 (Mounting and Systematization)

The step was performed in the same manner as in the step-m1 of Embodiment 1.

In the resultant image display apparatus after the step-i5, nearly no local discharge occurred as in the case of Embodiment 1. In other words, the ion pump container was securely fixed to the vacuum container and no vacuum leak occurred. Accordingly, high reliability and a reduction in cost were achieved.

Comparative Example

Figure 13:
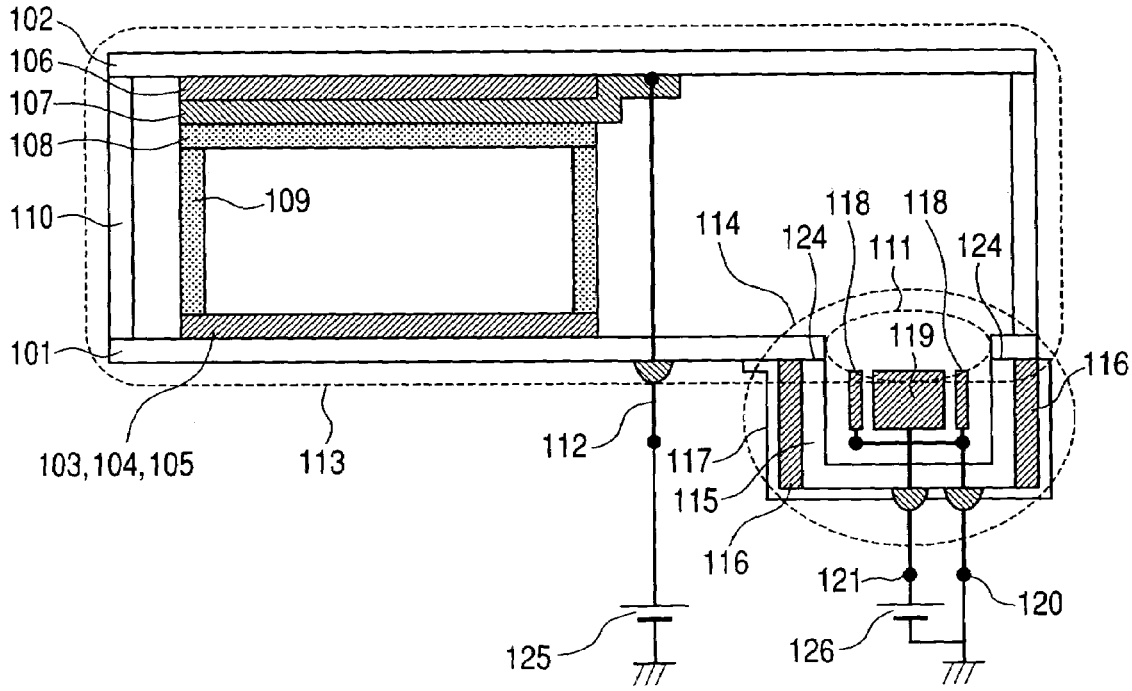
FIG. 13 is a schematic view showing a comparative example.

In this comparative example, an image display apparatus having electroconductive films formed on the external surface of a rear plate and on the internal surface of an ion pump container as shown in FIG. 13 was produced.

Step-A5 (Formation of Device Electrode)

A glass substrate 301 of PD-200 (manufactured by Asahi Glass Co., Ltd.) having a thickness of 2.8 mm was washed with a detergent, pure water, and an organic solvent, and an $SiO_2$ film having a thickness of 0.1 μm was formed by means of sputtering. Subsequently, a film of titanium (Ti) having a thickness of 5 nm was formed as a base layer on the $SiO_2$ film formed on the glass substrate 301 by means of sputtering, and a film of platinum. (Pt) having a thickness of 40 nm was formed on the titanium film. After that, a photoresist (AZ1370, manufactured by Hoechst) was applied, and the whole was patterned through a series of photolithography consisting of exposure, development, and etching to form device electrodes 330 and 331. The device electrodes were formed with an interval of 10 μm between them, and each had an opposing length of 100 μm.

Steps-B5 To G5, Y5, And H5 To L5

Steps similar to the steps-b1 to g1, y1, and h1 to l1 described in Embodiment 1 were repeated.

Step-M1 (Mounting and Systematization)

A flexible cable was mounted on the vacuum container formed through the above steps, and the ion pump 114 was connected at the same time. The anode terminal portion 121 of the ion pump 114 was subjected to potting, a treatment for solidification by means of a moisture-proof and high-resistance resin, as in the case of the anode connection terminal portion 112 of the image display portion, and a high voltage cable was connected. The high voltage cable of the image display portion was connected to the anode power source 125, and the high voltage cable of the ion pump 114 was connected to the high voltage power source 126 for an ion pump. After the completion of such mounting, the vacuum container was stored in a metal casing which had an opening on the face plate side in such a manner that the image display portion could be seen. Furthermore, an acrylic board was attached to the opening of the metal casing with a distance of about 5 mm between the board and the face plate 102. The resultant was connected to a dedicated driver apparatus as required to be subjected to a step of stabilizing device properties such as pre-driving or aging. At that time, a voltage was applied from the anode power source to the ion pump 114 to drive the ion pump 114. After that, a driver IC, the casing, and the like were assembled to complete the form of an image display apparatus.

A microammeter was connected between the ion pump cathode terminal 120 of the resultant image display apparatus after the step-M1 and the ground. First, a voltage of 3.5 kV was applied from the high voltage power source 126 for an ion pump to start current measurement. Immediately after the application of the ion pump voltage, a current of about 10 μA started to flow, and was lowered to 0.1 μA or less in about 1 minute. Subsequently, a voltage of 10 kV was applied from the anode power source 125 to measure a change in ion pump current while the image display apparatus was driven. The apparatus was driven for about 10 hours. A spike-like current exceeding 10 μA started to be intermittently observed after some period of time from the start of the driving. In addition, discharge was observed near the ion pump when the spike-like current flowed. The result shows that the ion pump steadily and efficiently exhausted the vacuum container to a vacuum, but sometimes caused discharge to emit a gas in one stroke.

As described above, according to the present invention, the operation of an ion pump is stable and no irregular gas emission occurs, so the luminance of an image display apparatus is stable when the image display apparatus is driven to measure a change in luminance. In addition, an image display apparatus attached with an ion pump having a container made of glass can be put into practical use, so reductions in size and weight, high reliability, and a reduction in cost can be achieved.

This application claims priority from Japanese Patent Application No. 2004-248547 filed Aug. 27, 2004, which is hereby incorporated by reference herein.

What is claimed is:

1. An image display apparatus, comprising:

a vacuum container which includes an electron source and an anode electrode opposed to the electron source and in which a pressure is maintained at a reduced pressure;

an anode power source for applying a voltage to the anode electrode; and an ion pump arranged so as to communicate through the vacuum container, wherein:

the ion pump comprises an ion pump container composed of a non-electroconductive material, an ion pump cathode and an ion pump anode, the ion pump cathode and the ion pump anode being disposed in the ion pump container; and an electroconductive film of which potential is regulated is formed on an external surface of the vacuum container on a side on which the ion pump container is mounted, and the external surface of the vacuum container on which the electroconductive film is formed is positioned at least inside of the ion pump container.

2. An image display apparatus, comprising:

a vacuum container which includes an electron source and an anode electrode opposed to the electron source and in which a pressure is maintained at a reduced pressure;

an anode power source for applying a voltage to the anode electrode; and an ion pump arranged so as to communicate through the vacuum container, wherein:

the ion pump comprises an ion pump container composed of a non-electroconductive material, an ion pump cathode and an ion pump anode, the ion pump cathode and the ion pump anode being disposed in the ion pump container; and an electroconductive film of which potential is regulated is formed on an internal surface of the ion pump container, and the internal surface of the ion pump container on which the electroconductive film is formed surrounds the ion pump cathode and the ion pump anode.

3. An image display apparatus, comprising:

a vacuum container which includes an electron source and an anode electrode opposed to the electron source and in which a pressure is maintained at a reduced pressure;

an anode power source for applying a voltage to the anode electrode; and an ion pump arranged so as to communicate through the vacuum container, wherein:

the ion pump comprises an ion pump container composed of a non-electroconductive material, an ion pump cathode and an ion pump anode, the ion pump cathode and the ion pump anode being disposed in the ion pump container;

an electroconductive film of which potential is regulated is formed on an external surface of the vacuum container on a side on which the ion pump container is mounted, and the external surface of the vacuum container on which the electroconductive film is formed is positioned at least inside of the ion pump container; and an electroconductive film of which potential is regulated is formed on an internal surface of the ion pump container, and the internal surface of the ion pump container on which the electroconductive film is formed surrounds the ion pump cathode and the ion pump anode.

4. An image display apparatus according to claim 1 or 3, wherein the potential of the electroconductive film formed on the external surface of the vacuum container comprises a ground potential.

5. An image display apparatus according to claim 2 or 3, wherein the potential of the electroconductive film formed on the internal surface of the ion pump container comprises a ground potential.

6. An image display apparatus according to any one of claims 1 or 3, wherein the electroconductive film formed on the external surface of the vacuum container is removed at a portion where the ion pump is connected to the vacuum container.

7. An image display apparatus according to any one of claims 1 to 3, wherein a periphery of a connection portion between the ion pump container and the vacuum container is reinforced with a reinforcing adhesive.

8. An image display apparatus according to claim 4, wherein the electroconductive film formed on the external surface of the vacuum container is removed at a portion where the ion pump is connected to the vacuum container.

* * * * *

UNITED STATES PATENT AND TRADEMARK OFFICE

CERTIFICATE OF CORRECTION

PATENT NO. : 7,301,269 B2
APPLICATION NO. : 11/210766
DATED : November 27, 2007
INVENTOR(S) : Ihachiro Gofuku et al.

It is certified that error appears in the above-identified patent and that said Letters Patent is hereby corrected as shown below:

ON COVER PAGE AT (75) INVENTORS

"Ihachiro Gofuku, Kanagawa-Ken (JP); Masaru Kamio, Kanagawa-Ken (JP); Hisanori Tsuda, Kanagawa-Ken (JP); Yasue Sato, Tokyo (JP); Yoshiyuki Shimada, Saitama-Ken (JP); Hiromasa Mitani, Kanagawa-Ken (JP); Kazuyuki Seino, Saitama-Ken (JP); Takashi Nishimura, Saitama-Ken (JP)"

should read

--Ihachiro Gofuku, Chigasaki (JP); Masaru Kamio, Sagamihara (JP); Hisanori Tsuda, Atsugi (JP); Yasue Sato, Machida (JP); Yoshiyuki Shimada, Fukaya (JP); Hiromasa Mitani, Hiratsuka (JP); Kazuyuki Seino, Fukaya (JP); Takashi Nishimura, Fukaya (JP)--.

COLUMN 5

Line 44, "such a" should read --such as--;
Line 47, "contain" should read --contains--; and
Line 60, "the resultant" should read --the result--.

COLUMN 6

Line 15, "view" should read --views--;
Line 32, "form" should read --from--; and
Line 33, "preliminary" should read --preliminarily--.

COLUMN 9

Line 40, "the resultant" should read --the result--; and
Line 42, "the resultant" should read --the result--.

COLUMN 11

Line 24, "members-were" should read --members were--.

UNITED STATES PATENT AND TRADEMARK OFFICE

CERTIFICATE OF CORRECTION

PATENT NO. : 7,301,269 B2
APPLICATION NO. : 11/210766
DATED : November 27, 2007
INVENTOR(S) : Ihachiro Gofuku et al.

It is certified that error appears in the above-identified patent and that said Letters Patent is hereby corrected as shown below:

COLUMN 13

Line 45, "the resultant" should read --the result--.

Signed and Sealed this

Twenty-second Day of July, 2008

JON W. DUDAS
*Director of the United States Patent and Trademark Office*